US008634757B2

(12) United States Patent
Takagi

(10) Patent No.: US 8,634,757 B2
(45) Date of Patent: Jan. 21, 2014

(54) IMAGE FORMING APPARATUS

(75) Inventor: Masaru Takagi, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 516 days.

(21) Appl. No.: 12/716,503

(22) Filed: Mar. 3, 2010

(65) Prior Publication Data

US 2010/0232854 A1 Sep. 16, 2010

(30) Foreign Application Priority Data

Mar. 11, 2009 (JP) ..... 2009-057575

(51) Int. Cl.
*G03G 15/00* (2006.01)

(52) U.S. Cl.
USPC ..... 399/401; 399/21; 399/124; 399/397; 400/692; 400/693

(58) Field of Classification Search
USPC ..... 399/401, 405, 21, 22, 388, 397, 124; 400/691, 692
See application file for complete search history.

(56) References Cited

U.S. PATENT DOCUMENTS

| | | | | |
|---|---|---|---|---|
| 5,797,068 | A * | 8/1998 | Otsuki et al. | 399/110 |
| 2005/0047827 | A1 * | 3/2005 | Komoda et al. | 399/124 |
| 2007/0077088 | A1 * | 4/2007 | Shiraishi et al. | 399/124 |

FOREIGN PATENT DOCUMENTS

| | | |
|---|---|---|
| JP | 2005-114979 | 4/2005 |

* cited by examiner

*Primary Examiner* — Matthew G Marini
(74) *Attorney, Agent, or Firm* — Smith, Gambrell & Russell, LLP

(57) ABSTRACT

An image forming apparatus 1 is provided with a double-side transport unit 80 capable of clearing a paper jam. The double-side transport unit 80 is provided with a reverse transport passage 75 provided with a reverse roller 57 for switching back paper P having an image formed on one side thereof, a return transport passage 76 for transporting the paper P turned upside down through the reverse transport passage 75 to an image forming portion 10, and a reverse introduction passage 74*a* extending from a downstream side, with respect to a branch transport passage 74, of the second transport roller 56 that is disposed close to the reverse transport passage 75, to the reverse transport passage 75. The double-side transport unit 80 can be taken out of or put in an apparatus main body 1*a* in a direction perpendicular to a paper transport direction.

7 Claims, 7 Drawing Sheets

IMAGE FORMING APPARATUS

This application is based on Japanese Patent Application No. 2009-057575 filed on Mar. 11, 2009, the contents of which are hereby incorporated by reference.

BACKGROUND OF THE INVENTION

1. Field of the Invention

The present invention relates to an image forming apparatus employing an electro-photographic method such as a copier, a printer, a facsimile machine, and a multifunction peripheral having these functions, and in particular, the present invention relates to an image forming apparatus that has a function of forming images on both sides of paper and is also capable of clearing paper jams.

2. Description of Related Art

Widely used conventional image forming apparatuses employ a double-side printing method in which an image is first formed on one side of paper at an image forming portion, and then the paper is transported back to the image forming portion, without being ejected, to have an image formed on the other side of the paper. An image forming apparatus using such a double-side printing method incorporates a double-side transport unit including: a reverse transport passage for reversing paper on one side of which an image is formed; and a return transport passage for transporting the reversed paper back to the image forming portion.

Such an image forming apparatus is inconvenient in that, when a paper jam occurs, the complicated paper transport route for double-side printing makes it difficult to clear the paper jam. In particular, image forming apparatuses have recently been made compact, and if such a complicated paper transport route is built inside a compact image forming apparatus, the paper transport route cannot be linear and needs to have many curves. As a result, it is difficult to remove jammed paper, and this makes it inconveniently difficult to clear a paper jam.

To cope with this inconvenience, in JP-A-2001-31285, an image forming apparatus comprises: a transport passage for transporting paper onto which an image has been transferred and fixed; an ejection transport passage for ejecting paper on which an image is fixed, the ejection transport passage having a switch-back roller therein; and a reverse transport passage into which paper that has been reversed (made to switch back) by the switch-back roller to move back proceeds. The reverse transport passage has a horizontal portion through which paper is transported substantially horizontally and a portion where paper from the horizontal transport passage is reversed by 180 degrees. The reverse transport passage is formed with a double-side guide member, and the double-side guide member is detachable by being pulled out of the apparatus from the front face of the apparatus main body. If paper that has been made to switch back in the ejection transport passage is jammed, the double-side guide member is detached from the apparatus main body for a user to remove the jammed paper by inserting his/her hand into a space appearing after the double-side guide member is detached. By making it possible to clear a paper jam from the front side of the apparatus, easy jam clearance is realized without occupying a large space.

The image forming apparatus disclosed in the above Patent Document employs a method in which the double-side guide member is taken out of or put in the apparatus main body in the same direction as the direction in which paper onto which an image is to be transferred and fixed is transported, but there are image forming apparatuses in which the double-side guide member is taken out of or put in the apparatus main body in a direction perpendicular to the direction in which paper onto which an image is to be transferred and fixed is transported.

For example, in JP-A-2007-217126, an image forming apparatus comprises: a transport passage for transporting paper onto which an image is to be transferred and fixed; a transport passage formed between a fixing portion and a paper ejection portion; and a branch transport passage formed between the fixing portion and the double-side transport unit. In the double-side transport unit, the following portions are formed: a switch-back roller that accepts paper sent from the branch transport passage and sends it into a withdrawal tray and then makes the paper switch back to be sent out of the withdrawal tray; a passage for reversing the paper sent from the switch-back roller by 180 degrees; and a return transport passage for transporting the paper reversed by 180 degrees to an image forming portion. In this image forming apparatus, if the paper that has been made to switch back by the switch-back roller is jammed, the double-side transport unit is taken out of the apparatus main body by being pulled frontward, that is, in a direction perpendicular to the direction in which paper onto which an image is to be transferred and fixed is transported, and then the paper jam is cleared. However, if the jammed paper is stuck between the double-side transport unit and the branch transport passage, when the double-side transport unit is pulled out of the apparatus from the front face thereof, the jammed paper is torn off and part of the paper is stuck in the apparatus main body, which is quite inconvenient.

SUMMARY OF THE INVENTION

The present invention has been made to solve the above problems, and an object of the present invention is to provide an image forming apparatus allowing easy clearance of paper jam occurring in a double-side printing operation.

To achieve the above object, according to one aspect of the present invention, an image forming apparatus is provided with: an image forming portion provided in an image forming apparatus main body; an image forming transport passage for transporting paper having an image transferred thereon at the image forming portion to a fixing portion; an ejection transport passage for transporting paper having an image fixed thereon to an ejection portion; a reverse transport passage having a reverse roller for switching back paper having an image formed on one side thereof; a return transport passage for transporting paper turned upside down through the reverse transport passage to the image forming portion; a branch transport passage branching off the ejection transport passage and having at least one transport roller for transporting paper to the reverse transport passage; and a double-side transport unit including the reverse transport passage, the return transport passage, and a reverse introduction passage extending from a downstream side, with respect to the branch transport passage, of the transport roller to the reverse transport passage, the double-side transport unit being capable of being taken out of or put in the apparatus main body in a direction perpendicular to a paper transport direction in which paper is transported.

With this structure, when paper sent from the branch transport passage is jammed in the vicinity of the reverse roller of the double-side transport unit, even if the jammed paper is stuck between the reverse transport passage and the reverse introduction passage, merely by pulling the double-side transport unit in a direction perpendicular to the paper transport direction to take it out of the apparatus main body, the jammed paper is taken out of the apparatus main body together with the double-side transport unit, leaving no part of the jammed paper remaining in the apparatus main body. In this way, the paper jam is easily cleared.

According to the present invention, it is preferable that, in the image forming apparatus structured as described above, the double-side transport unit comprise an open/close subunit that includes: the reverse introduction passage; and a junction portion at which a transport passage for transporting paper switched back by the reverse roller and the reverse introduction passage meet each other, and that the open/close subunit be rotatable around the reverse roller.

With this structure, the open/close subunit is rotated to be opened to widely open the transport passage, and this makes it easy to take the jammed paper, which is taken out of the apparatus main body together with the double-side transport unit, out of the transport passage. Furthermore, since the double-side transport unit is provided with the junction portion at which the transport passage for transporting paper switched back by the reverse roller and the reverse introduction passage meet each other, and the reverse roller, even after the double-side transport unit is repeatedly taken out of and put in the apparatus main body to clear paper jams, a transport distance from the junction portion to the reverse roller does not change but always stays constant. As a result, sheets of paper are transported at regular intervals even in repeated double-side printing operations, and this facilitates control of paper transport.

According to the present invention, in the image forming apparatus structured as described above, it is preferable that the reverse roller be made to rotate so as to transport paper from the reverse introduction passage to the reverse transport passage, that the open/close subunit have a detection member for detecting passing of paper transported to the reverse introduction passage, and that the reverse roller be made to reversely rotate based on detection of passing of paper by the detection member.

With this structure, where the reverse roller is made to reversely rotate when the detection member detects passing of paper, the detection member, the reverse roller, and the junction portion are all provided in the open/close subunit. As a result, the transport distance between the detection member and the reverse roller and the transport distance between the reverser roller and the junction portion do not vary. Thus, serially transported sheets of paper are switched back at regular timings, and thus transported at regular intervals.

According to the present invention, in the image forming apparatus structured as described above, it is preferable that the reverse roller include a reverse drive roller and a reverse driven roller facing the reverse drive roller below the reverse drive roller, and that the open/close subunit be rotatable around the reverse drive roller.

With this structure, the open/close subunit is rotated to be opened to widely open the transport passage, and this makes it easy to take the jammed paper, which is taken out of the apparatus main body together with the double-side transport unit, out of the transport passage.

According to the present invention, it is preferable that the image forming apparatus structured as described above further include a side panel for holding the transport roller at an end of the transport roller in an axial direction of the transport roller. Here, the side panel has a cut portion wide enough for paper remaining in the branch transport passage to pass therethrough.

With this structure, if jammed paper is stuck in the vicinity of the transport roller in the branch transport passage, when the double-side transport unit is pulled in the direction perpendicular to the paper transport direction and taken out of the apparatus main body to clear the paper jam, one end of the jammed paper passes through the cut portion, and thus the jammed paper is securely taken out of the apparatus main body.

According to the present invention, in the image forming apparatus structured as described above, it is preferable that the double-side transport unit include: a junction portion at which a transport passage for transporting paper switched back by the reverse roller and the reverse introduction passage meet each other; and a detection member for detecting passing of paper transported to the reverse introduction passage, and that the reverse roller be made to reversely rotate based on detection of passing of paper by the detection member.

With this structure, where the reverse roller is made to reversely rotate when the detection member detects passing of paper, the detection member, the reverse roller, and the junction portion are all provided in the double-side transport unit. As a result, the transport distance between the detection member and the reverse roller and the transport distance between the reverser roller and the junction portion do not vary. Thus, serially transported sheets of paper are switched back at regular timings, and thus transported at regular intervals.

According to the present invention, in the image forming apparatus structured as described above, it is preferable that the reverse transport passage be provided with a direction change roller for changing a paper transport direction by 180 degrees at a downstream side of the reverse roller in the paper transport direction.

According to another aspect of the present invention, an image forming apparatus is provided with a double-side transport unit including: a reverse transport passage provided with a reverse roller for switching back paper having an image formed on one side thereof; a return transport passage for transporting paper turned upside down through the reverse transport passage to an image forming portion; and a reverse introduction passage extending, from a downstream side of a branch transport passage for transporting paper toward the reverse transport passage to the reverse transport passage, the double-side transport unit being capable of being taken out of or put in the apparatus main body in a direction perpendicular to a paper transport direction.

With this structure, when paper sent from the branch transport passage is jammed in the vicinity of the reverse roller of the double-side transport unit, even if the jammed paper is stuck between the reverse transport passage and the reverse introduction passage, merely by pulling the double-side transport unit in a direction perpendicular to the paper transport direction to take it out of the apparatus main body, the jammed paper is taken out of the apparatus main body together with the double-side transport unit, leaving no part of the jammed paper remaining in the apparatus main body. In this way, the paper jam is easily cleared.

DETAILED DESCRIPTION OF PREFERRED EMBODIMENTS

Hereinafter, embodiments of the present invention will be described with reference to the attached drawings, but it should be understood that the present invention is not limited to these embodiments. Also, the application of the present invention described herein and terms used in the description should not be construed in a limited manner.

Figure 1:
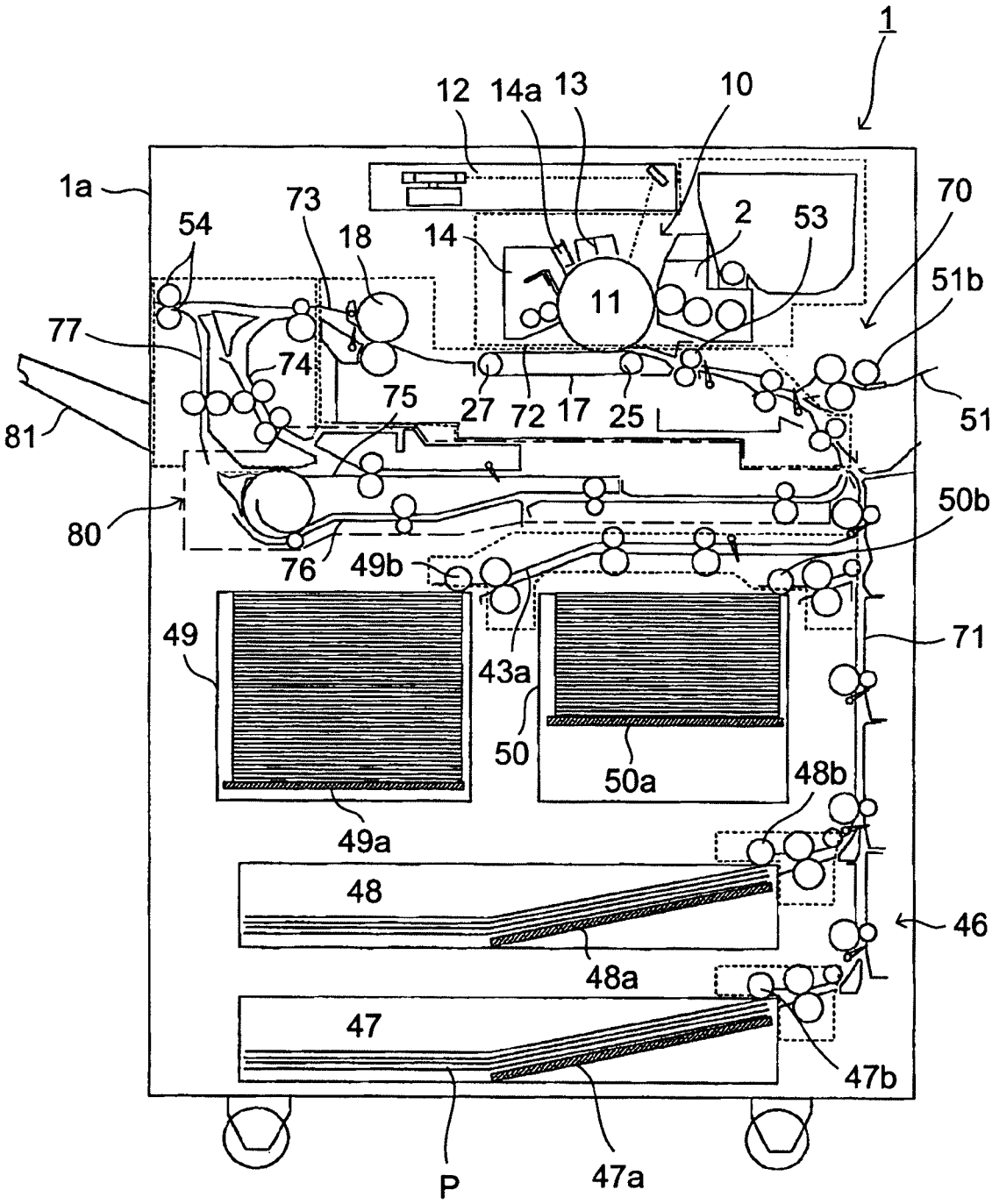
FIG. 1 is a sectional view schematically showing an image forming apparatus embodying the present invention.

FIG. 1 is a sectional view schematically showing an overall structure of an image forming apparatus 1 of the present invention. The image forming apparatus 1 is provided with an apparatus main body 1*a* formed in the shape of a rectangular parallelpiped, and an image forming portion 10 is provided in an upper portion of the apparatus main body 1*a*. The image forming portion 10 is provided with a photoconductive body 11, and is also provided with a charger 13, a developing unit 2, a cleaning unit 14, and a charge removing unit 14*a* arranged around the photoconductive body 11. The photoconductive body 11, which is rotatable, has a photoconductive layer made of a photoconductive material such as an amorphous silicon photoconductor or an organic photoconductor (OPC photoconductor).

An exposure unit 12, which is disposed at a downstream side of the charger 13 in the rotation direction of the photoconductive body 11, irradiates the photoconductive body 11 with laser light based on image data of an original copy inputted to an image input portion (unillustrated).

A transfer transport belt 17 is wound around the transfer roller 25 and a driven roller 27, and the transfer roller 25 is disposed so as to face the photoconductive body 11 with the transfer transport belt 17 therebetween.

When an operation is performed to start an image forming process, the photoconductive body 11 rotates clockwise in FIG. 1, the charger 13 uniformly charges the surface of the photoconductive body 11, the exposure unit 12 irradiates the surface of the photoconductive body 11 with laser light based on the image data, and thereby an electrostatic latent image is formed on the surface of the photoconductive body 11. Next, due to a developing bias applied to a developing roller of a developing unit 2, toner adheres to the electrostatic latent image formed on the surface of the photoconductive body 11, and thereby a toner image is formed.

The toner image formed on the surface of the photoconductive body 11 is transferred by the transfer roller 25, to which a transfer bias potential is applied, onto paper transported via the transfer transport belt 17.

The cleaning unit 14 removes toner remaining on the surface of the photoconductive body 11 without being transferred onto the paper, and the charge removing unit 14*a* removes electric charge remaining on the surface of the photoconductive body 11.

A paper feed portion 46 is composed of paper feed cassettes 47 and 48, large-capacity decks 49 and 50, manual paper feed tray 51, and the like. The paper feed cassettes 47 and 48 are arranged one over the other at the bottom of the apparatus main body 1*a*, and paper P is placed on paper placing plates 47*a* and 48*a* of the paper feed cassettes 47 and 48, respectively. Above the paper feed cassette 48, the large-capacity decks 49 and 50 having paper placing plates 49*a* and 50*a* on which paper P is placed are arranged side by side. For the purpose of sending out the paper P placed on the paper placing plates 47*a* to 50*a* sheet by sheet into the paper transport passage, the paper feed portion 46 has pickup rollers 47*b* to 50*b* provided at upper right portions of the paper feed cassettes 47, 48 and the large-capacity decks 49, 50, respectively. Furthermore, the manual paper feed tray 51 is provided on the right side face of the apparatus main body 1*a* for feeding paper by hand, and the manual paper feed tray 51 is also provided with a pickup roller 51*b* for sending out the paper P sheet by sheet into the paper transport passages. Moreover, a resist roller 53 is provided to the right of the transfer roller 25, for the purpose of controlling the timing of transporting the paper P to the image forming portion 10.

A paper transport portion 70 is provided for transporting the paper P in the image forming apparatus 1, and includes a paper feed transport passage 71, an image forming transport passage 72, an ejection transport passage 73, a branch transport passage 74, a reverse transport passage 75, a return transport passage 76, and a reverse ejection transport passage 77.

The paper feed transport passage 71, which is a transport passage from the paper feed portion 46 to the resist roller 53, is formed in the right part of the apparatus main body 1*a* to extend upward from the lower paper feed cassette 47. A transport passage for the upper paper feed cassette 48, a transport passage for the large-capacity deck 50, and a transport passage for the large-capacity deck 49 join the paper feed transport passage 71 in this order upward from the paper feed cassette 47.

The image forming transport passage 72, which is a transport passage from the resist roller 53 to the fixing portion 18, is formed to extend substantially horizontally in the apparatus main body 1*a*. The image forming portion 10 and the fixing portion 18 are arranged along the image forming transport passage 72. An image is transferred onto the paper P at the image forming portion 10, and then the image is fixed on the paper P at the fixing portion 18.

The ejection transport passage 73, which is a transport passage from the fixing portion 18 to the ejection roller 54, is formed to extend substantially horizontally leftward from the fixing portion 18. At the ejection transport passage 73, the paper P having an image fixed thereon is ejected onto an ejection tray 81, which is an ejection portion, via an ejection roller 54.

The branch transport passage 74 is used, as necessary, for forming an image on the rear surface of the paper P as well after fixing an image on the front surface of the paper P. The branch transport passage 74 branches off the ejection transport passage 73 at a midpoint along the ejection transport passage 73 and extends to below the fixing portion 18, forming a U-shape, and into a double-side transport unit 80.

The double-side transport unit 80, which is indicated by the alternate long and two short dashes line in FIG. 1, includes part of the branch transport passage 74, the reverse transport passage 75, the return transport passage 76, and part of the reverse ejection transport passage 77. The double-side transport unit 80 turns the paper P upside down and transports the paper P to the image forming portion 10. The double-side transport unit 80 is formed below the image forming transport passage 72, extending from left to right, and joins the paper feed transport passage 71 above the transport passage 43*a* for the large-capacity deck 49. Furthermore, the double-side transport unit 80 is formed with a substantially rectangular parallelepiped frame body, and is capable of being pulled out of or pushed into the apparatus main body 1*a* along a guide rail (unillustrated), which is provided in the apparatus main body 1*a*, in a frontward or rearward direction (in a front or rear surface direction of FIG. 1) of the apparatus main body 1*a*. If a paper jam occurs in, for example, the reverse transport passage 75, the double-side transport unit 80 is pulled along the guide rail out of the apparatus main body 1*a* to clear the paper jam. After the paper jam is cleared, the double-side transport unit 80 is pushed along the guide rail into the apparatus main body 1*a*.

The paper P fed from the paper feed portion 46 is transported upward through the paper feed transport passage 71, to be further transported, by the resist roller 53, to the transfer roller 25 at a proper transport timing. The transfer roller 25 transfers a toner image onto the paper P. The paper P, after the toner image is transferred thereonto, is transported on the image forming transport passage 72 to the fixing portion 18. There, heat and pressure is applied to the paper P by a fixing roller and a pressure roller of the fixing portion 18, and thereby the toner image is melted and fixed on the paper P. The paper P having the image fixed thereon passes through the ejection transport passage 73 to be ejected by the ejection roller 54 onto the ejection tray 81.

In a double-side printing operation, the paper P having an image fixed thereon at the fixing portion 18 is transported to the branch transport passage 74, turned upside down through the reverse transport passage 75, and then transported again to the paper feed transport passage 71 from the return transport passage 76. The paper P transported to the paper feed transport passage 71 is again transported to the image forming portion 10 to have a toner image transferred onto its rear surface. The toner image is melted and fixed at the fixing portion 18, and then the paper P is ejected onto the ejection tray 81.

Figure 2:
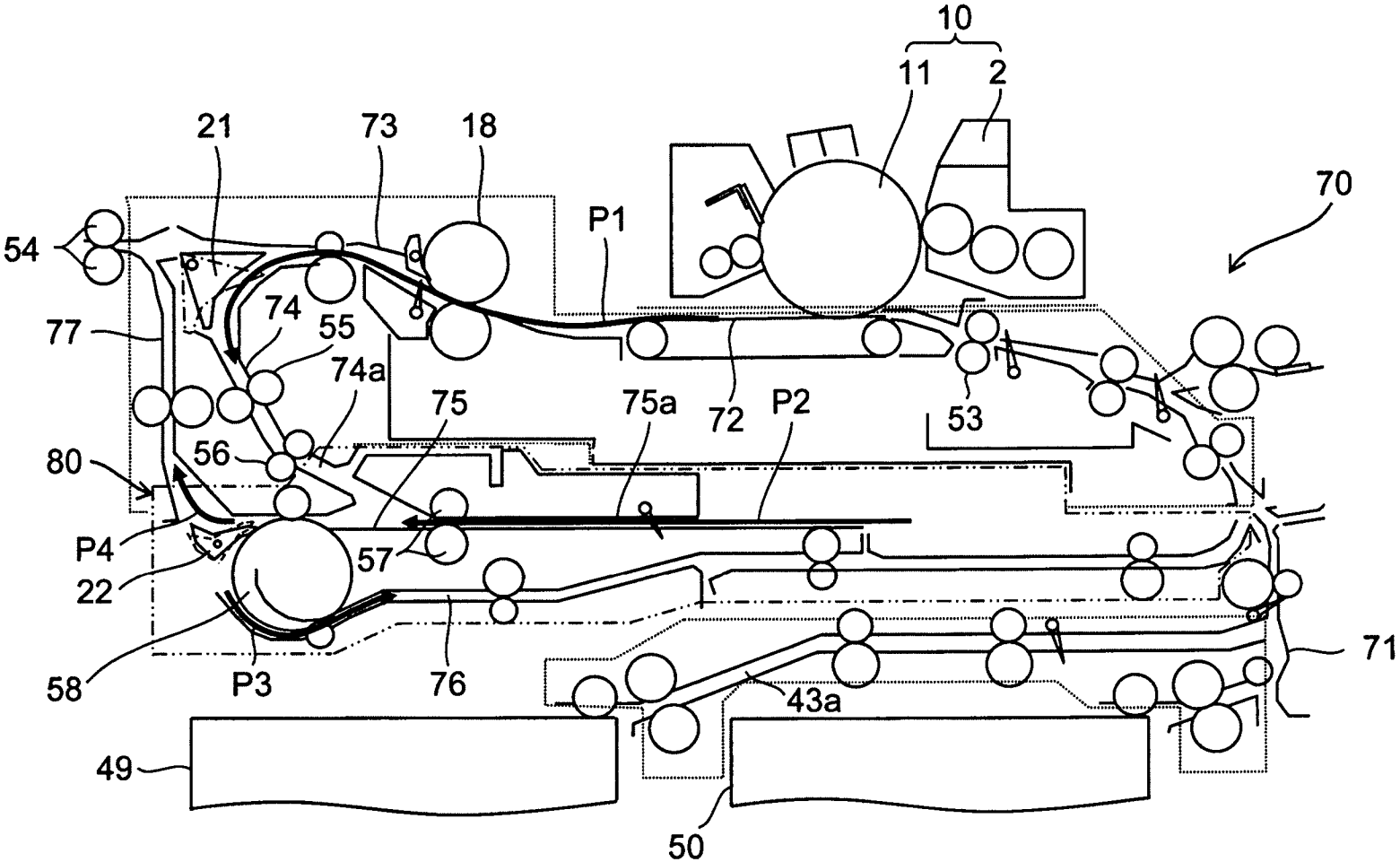
FIG. 2 is a sectional view schematically showing a paper transport portion in an image forming apparatus embodying the present invention.

A detailed description will be given of the paper transport portion 70, based on FIG. 2. FIG. 2 is a sectional view schematically showing a principal part of the paper transport portion. In the figure, sheets of paper denoted by signs P1-P4 indicate the order in which the paper P is transported along the paper transport route.

A branching claw 21 is provided at the position where the branch transport passage 74 branches off the ejection transport passage 73. The branching claw 21 is provided for switching the transport direction of the paper P1 having an image fixed thereon between toward the ejection roller 54 and toward the branch transport passage 74. The branching claw 21 is swingable around a shaft between a position indicated by a solid line and a position indicated by an alternate long and short dash line in FIG. 2. When the branching claw 21 is located at the position indicated by the solid line, the paper P is transported to the branch transport passage 74, and when the branching claw 21 is located at the position indicated by the alternate long and short dash line, the paper P is transported toward the ejection roller 54. Normally, the branching claw 21 is located at the position indicated by the alternate long and short dash line, and the paper P, having an image printed on its front side, is transported toward the ejection roller 54. When a double-surface printing mode is selected, the branching claw 21 is moved to the position indicated by the solid line by driving means such as a solenoid (unillustrated), and the paper P is transported to the branch transport passage 74 for an image to be formed on its rear side as well.

In the branch transport passage 74, there are provided first and second transport rollers 55 and 56 by which the paper P1 is transported to the reverse transport passage 75. The passage extending from the downstream side, with respect to the branch transport passage 74, of the second transport roller 56 to a reverse roller 57 is a reverse introduction passage 74*a*, which is inclined right downward. The reverse introduction passage 74*a* is included in the double-side transport unit 80.

The reverse transport passage 75 is provided with the reverse roller 57 and a direction change roller 58. The paper P transported from the branch transport passage 74 is drawn into a reverse portion 75*a* by the reverse roller 57. Thereafter, the paper P is made to move back (switch back), and then, the transport direction of the paper P is changed by 180 degrees by the direction change roller 58. Thus, the reverse transport passage 75 includes: a transport passage of the reverse portion 75*a* horizontally extending from the reverse roller 57; and a transport passage that horizontally extends to the left from the reverse roller 57 and whose direction is changed by 180 degrees at the direction change roller 58.

The reverse roller 57 is provided near the entrance of the reverse portion 75*a*, at an upstream side of the direction in which the paper P is transported to the direction change roller 58. The reverse roller 57 transports the paper P sent from the reverse introduction passage 74*a* to a predetermined position (the position of the paper P2) in the reverse portion 75*a*. When the paper P is located at the predetermined position (P2), the reverse roller 57 reversely rotates to make the paper P switch back to be transported to the direction change roller 58. The direction change roller 58 rotates counterclockwise to change the paper P transport direction by 180 degrees and transport the paper P to the return transport passage 76.

The return transport passage 76 is a transport passage that is formed to extend to the right from the direction change roller 58 to join the paper feed transport passage 71 above the transport passage 43*a* for the large-capacity deck 49. The return transport passage 76 transports the paper P that has been turned upside down through the reverse transport passage 75 to the image forming portion 10 again.

The direction change roller 58 is provided with a branching claw 22. The branching claw 22 switches the transport direction of the paper P sent from the reverse roller 57 between the return transport passage 76 side and the reverse ejection transport passage 77 side. The branching claw 22 is swingable around a shaft between a position indicated by a solid line and a position indicated by a broken line in FIG. 2. When the branching claw 22 is in the position indicated by the broken line, the paper P2 is transported to the return transport passage 76 (the direction indicated by P3 in FIG. 2) and then to the image forming portion 10, where an image is printed on the rear side of the paper P. The paper P having an image printed on each side thereof is transported via the branch transport passage 74 to be drawn into the reverse portion 75*a*. The branching claw 22 is moved to the position indicated by the solid line to transport the paper P through the reverse ejection transport passage 77 (in the direction indicated by P4 in FIG. 2) to be ejected. The branching claw 22 is moved to the positions indicated by the solid line and the broken line by driving means such as a solenoid (unillustrated).

The reverse ejection transport passage 77 is a transport passage formed to extend upward from the direction change roller 58 to join the ejection transport passage 73. The reverse ejection transport passage 77 transports the paper P having an image transferred and fixed on each side thereof from the reverse transport passage 75 to the ejection transport passage 73. The upstream part of the reverse ejection transport passage 77, which is a part close to the reverse transport passage 75, is included in the double-side transport unit 80.

Figure 3:
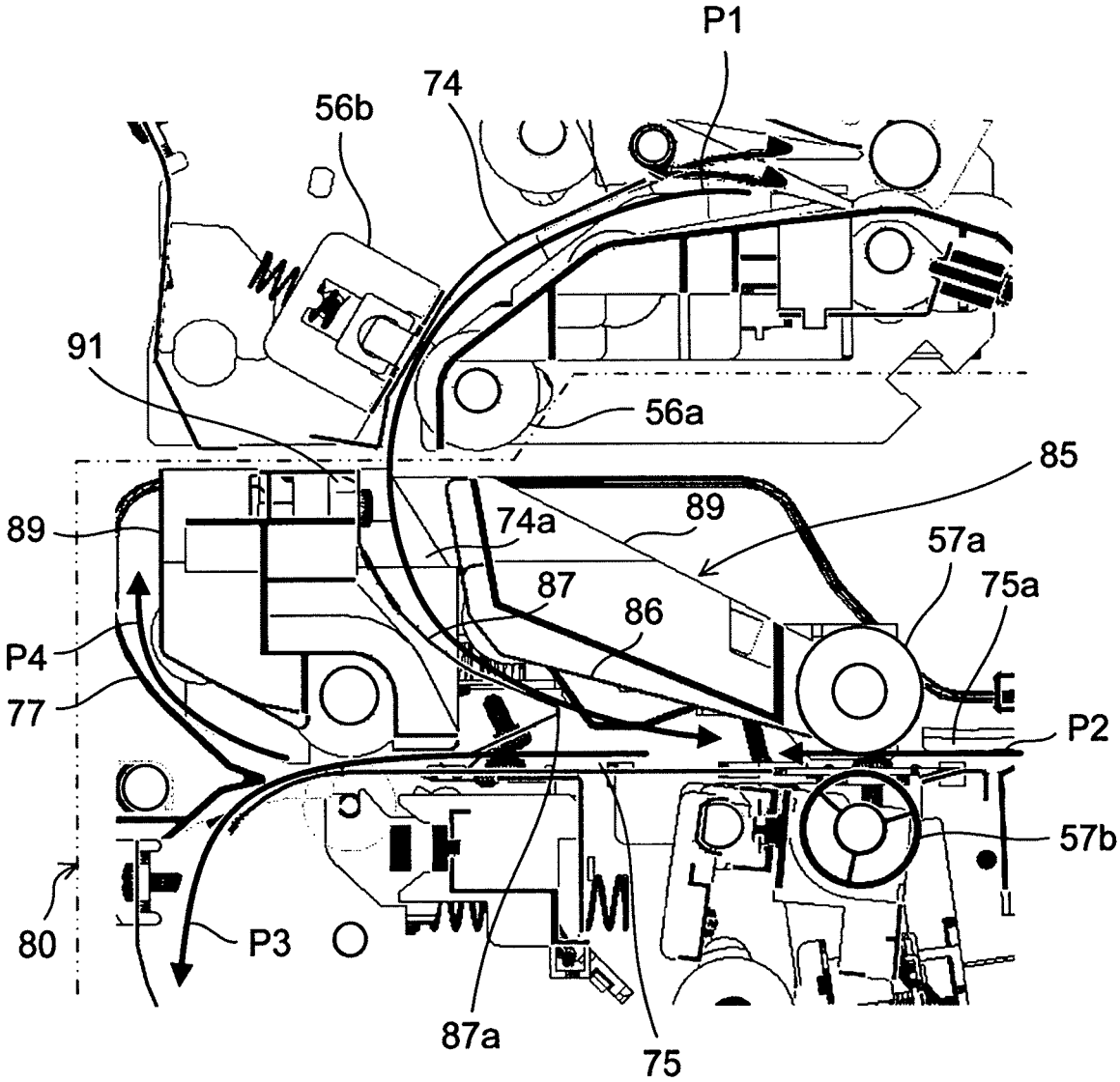
FIG. 3 is a sectional view showing a principal part of a double-side transport unit in an image forming apparatus embodying the present invention.
Figure 4:
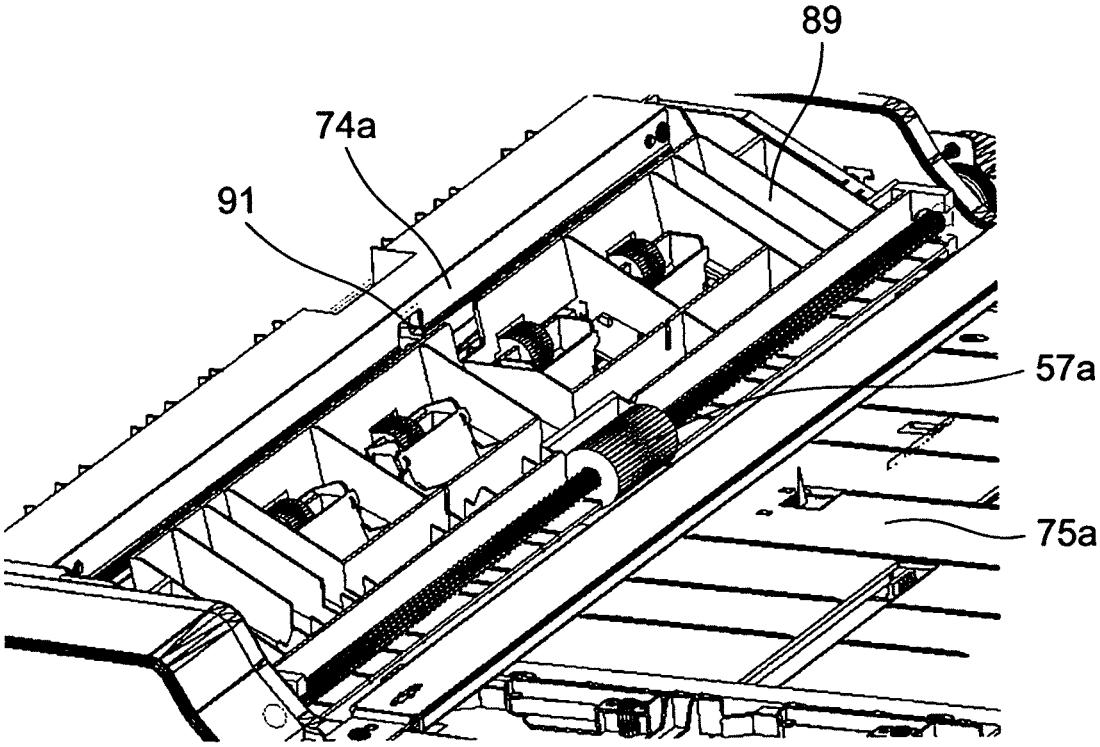
FIG. 4 is a perspective view showing a principal part of a double-side transport unit in an image forming apparatus embodying the present invention.

Next, the double-side transport unit 80 will be described in detail, based on FIGS. 3 and 4. FIG. 3 is a sectional view showing the principal part of the double-side transport unit 80. FIG. 4 is a perspective view showing the principal part of the double-side transport unit 80 pulled out of the apparatus main body 1*a*.

In addition to the above described reverse introduction passage 74*a* (part of the branch transport passage 74), the reverse transport passage 75, the return transport passage 76 (see FIG. 2), part of the reverse ejection transport passage 77, the reverse roller 57, and the direction change roller 58 (see FIG. 2), the double-side transport unit 80 includes, as shown in FIG. 3, upper-side and lower-side introduction guides 86 and 87 that form the reverse introduction passage 74*a*, a detection member 91, and a subunit main body 89. The subunit main body 89 holds the upper-side introduction guide 86, the lower-side introduction guide 87, and the detection member 91. Furthermore, the subunit main body 89 includes part of the reverse ejection transport passage 77, and forms an open/close subunit 85.

The reverse roller 57 includes a reverse drive roller 57*a* and a reverse driven roller 57*b* that is located directly under the reverse drive roller 57*a*, facing the reverse drive roller 57*a*. The reverse drive roller 57*a* is provided to be located substantially centrally in the direction perpendicular to the paper transport direction (see FIG. 4), and the reverse drive roller 57*a* is driven by driving means such as an unillustrated motor and a speed reduction gear array to rotate forward and backward. The reverse drive roller 57*a* rotates forward to transport the paper P from the reverse introduction passage 74*a* to the reverse portion 75*a*, while the reverse drive roller 57*a* rotates backward (reversely) to transport the paper P from the reverse portion 75*a* to the direction change roller 58 side (direction indicated by P3 or by P4). The subunit main body 89 (the open/close subunit 85) is supported by a rotation shaft of the reverse drive roller 57*a* to be rotatable around the rotation shaft. Thus, when the double-side transport unit 80 is pulled out of the apparatus main body 1*a*, the open/close subunit 85 is rotatable around the reverse roller 57, and this makes it possible to open/close the reverse transport passage 75 with respect to the double-side transport unit 80.

The reverse driven roller 57*b* is provided to be capable of being brought into/out of contact with the reverse drive roller 57*a*. When the reverse driven roller 57*b* is in contact with the reverse drive roller 57*a*, the reverse driven roller 57*b* is made to rotate following the reverse drive roller 57*a*, and nips and transports the paper P together with the reverse drive roller 57*a*. In continuously performed printing operations, the paper P1 and the paper P2 that has been made to switch back are superposed one on the other at the reverse roller 57. In this state, the reverse driven roller 57*b* is brought out of contact with the reverse drive roller 57*a* to transport the paper P1 and the paper P2 respectively in opposite directions. Incidentally, when the reverse driven roller 57*b* is out of contact with the reverse drive roller 57*a*, the paper P1 is transported by the second transport roller 56 while the paper P2 is transported by the direction change roller 58. The reverse driven roller 57*b* is regularly out of contact with the reverse drive roller 57*a*, but when the reverse drive roller 57*a* rotates forward or backward, the reverse driven roller 57*b* is brought into contact with the reverse drive roller 57*a* by driving means such as a solenoid (unillustrated).

The upper-side and lower-side introduction guides 86 and 87 are each formed of a metal plate or a synthetic resin member, and they are both fixed to the subunit main body 89. The lower-side introduction guide 87 forming the reverse introduction passage 74*a* has a junction portion 87*a* at its lower end. The junction portion 87*a* is where the reverse introduction passage 74*a* and the reverse transport passage 75 to which the paper P2 that has been made to switch back is transported meet each other. When the rear end of the paper P advancing into the reverse introduction passage 74*a* passes by the junction portion 87*a*, the paper P is allowed to switch back from the reverser portion 75*a*. The distance between the junction portion 87*a* and the nip portion of the reverse roller 57 is set to a predetermined value, and this setting determines the timing of switching back of the paper P.

The detection member 91 is disposed substantially in the middle of the reverse introduction passage 74*a* in the direction perpendicular to the paper transport direction (see FIG. 4), and it is fixed to the subunit main body 89 at a position in the vicinity of the lower side of the second transport roller 56. The detection member 91 is formed with a reflection-type optical sensor. The optical sensor irradiates the reverse introduction passage 74*a* with light, and the paper P reflects the light when it passes by the optical sensor. The optical sensor senses the light reflected from the paper P, and thereby the detection member 91 detects the paper P passing thereby. Time that the rear end of the paper P is to take to reach the junction portion 87*a* is obtained based on the detection of the passing of the paper P by the detection member 91, the dimension of the paper P in the paper transport direction, the speed at which the paper P is transported, and the like, and stored in an unillustrated memory portion such as a ROM. When the time has passed, an unillustrated drive control portion makes the reverse drive roller 57*a* reversely rotate. The reverse rotation of the reverse drive roller 57*a* makes the paper P switch back.

The second transport roller 56, which is provided in the vicinity of the upper side of the double-side transport unit 80, includes a second transport drive roller 56*a* and a second transport driven roller 56*b* that faces and is pressed against the second transport drive roller 56*a*. When the second transport drive roller 56*a* is driven to rotate, the paper P held between the second transport drive roller 56*a* and the second transport driven roller 56*b* is transported to the reverse introduction passage 74*a*.

Figure 5:
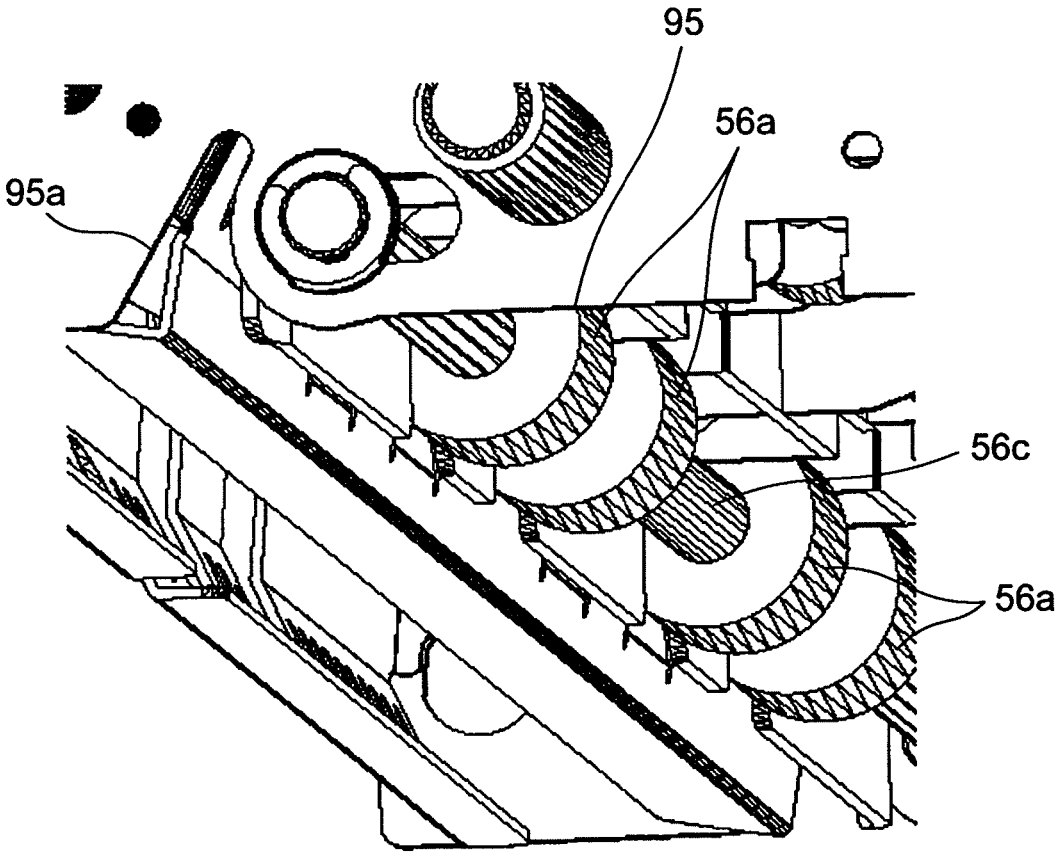
FIG. 5 is a perspective view showing a principal part of a side panel holding a transport roller in an image forming apparatus embodying the present invention.

As shown in FIG. 5, the second transport roller 56 is held in the apparatus main body 1*a*. FIG. 5 is a perspective view showing the principal part of a side panel 95 holding the transport roller 56.

The second transport drive roller 56*a* includes a plurality of rollers fitted to a rotation shaft 56*c*, and the rotation shaft 56*c* is held, at an end thereof in an axial direction thereof, by a side panel 95 fitted to the apparatus main body 1*a*. In the lower edge of the side panel 95, a cut portion 95*a* is formed in a shape corresponding to the shape of the branch transport passage 74. If the paper P is jammed in the double-side transport unit 80, with the rear end of the paper P protruding from the double-side transport unit 80 toward the second transport roller 56, the protruding rear end of the paper P passes through the cut portion 95*a* when the double-side transport unit 80 is taken out of the apparatus main body 1*a*.

Figure 6:
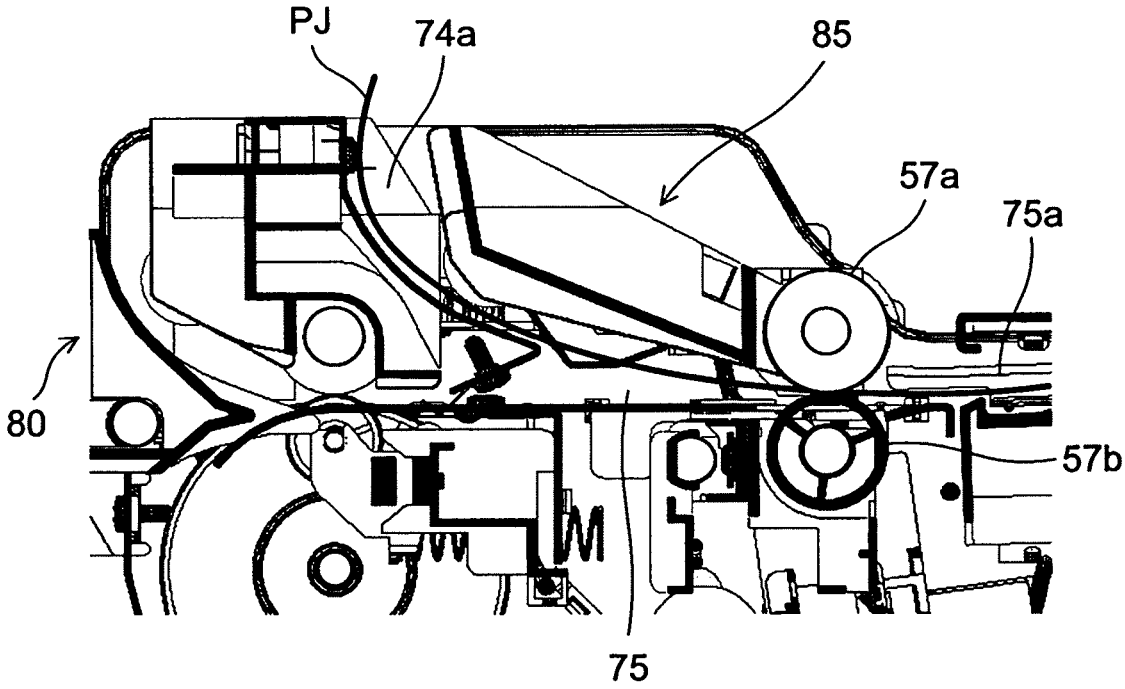
FIG. 6 is a sectional view showing a state in which a paper is jammed in a double-side transport unit in an image forming apparatus embodying the present invention.

Next, based on FIGS. 6 and 7, a description will be given of how a paper jam is cleared. FIG. 6 is a sectional view showing a state in which a paper jam has occurred in the double-side transport unit, and FIG. 7 is a sectional view showing the open/close subunit 85 when it is opened to clear the paper jam.

As shown in FIG. 6, when a paper jam occurs in the vicinity of the reverse roller 57 in the reverse transport passage 75, the jammed paper PJ is stuck in the reverse portion 75*a*, between the reverse rollers 57*a* and 57*b*, and in the reverse introduction portion 74*a*, and the rear end of the jammed paper protrudes upward from the double-side transport unit 80. The apparatus main body 1*a* is provided with means for manually rotating the transport rollers (such as the ejection roller 54 and the first and second transport rollers 55 and 56, see FIG. 2) provided in the fixing portion 18 and downstream from the fixing portion 18. If a paper jam occurs to stop the operation of the apparatus, an unillustrated cover member is opened, and an unillustrated knob is turned by hand to make the first transport roller 55, the second transport roller 56, and the like rotate to transport the paper toward the downstream side until the rear end of the paper passes by the second transport roller 56. Thus, the state shown in FIG. 6 is achieved. Then the double-side transport unit 80 is pulled out of the apparatus main body 1*a* with the jammed paper PJ in this state. In this process, the rear end of the jammed paper PJ passes through the cut portion 95*a* of the side panel 95 (see FIG. 5), and the jammed paper PJ is taken out of the apparatus main body 1*a* together with the double-side transport unit 80. In this state, the jammed paper PJ is removed from the reverse portion 75*a* side or from the entrance side of the reverse introduction passage 74*a*.

Figure 7:
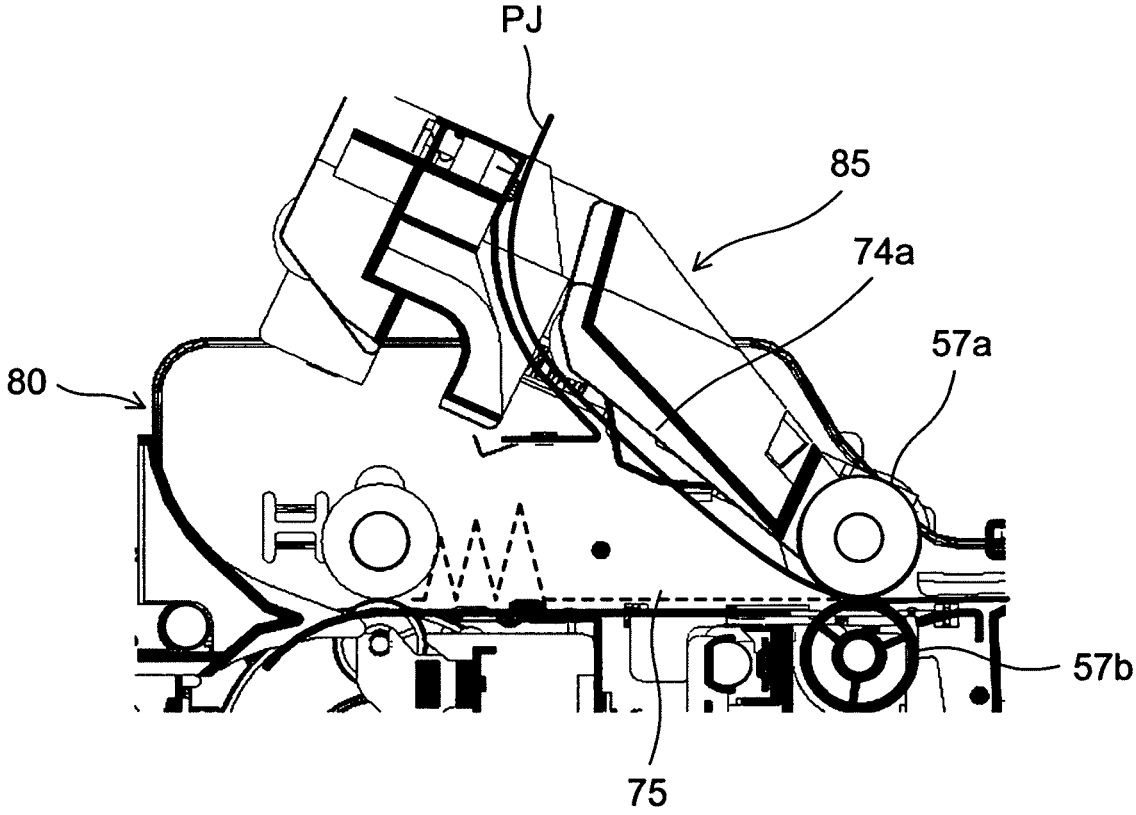
FIG. 7 is a sectional view showing an open/close subunit in an image forming apparatus embodying the present invention when the open/close subunit is opened.

Next, the open/close subunit 85 is made to rotate clockwise around the reverse drive roller 57*a* to widely open the reverse transport passage 75 and the reverse introduction passage 74*a* as shown in FIG. 7. Then, a user reaches the jammed paper PJ from the widely opened transport passages to take it out of the double-side transport unit 80. Also, if the paper P is jammed in an accordion shape (as indicated by a dotted line in FIG. 7) on its way from the reverse roller 57 to the direction change roller 57 (see FIG. 2), the user reaches the jammed paper PJ from the widely-opened transport passage to take it out of the double-side transport unit 80 by hand.

According to the above embodiment, the image forming apparatus 1 includes: the image forming portion 10 provided in the apparatus main body 1*a*; an image forming transport passage 72 for transporting the paper P having an image transferred thereon at the image forming portion 10 to the fixing portion 18; the ejection transport passage 73 for transporting the paper P having an image fixed thereon to the ejection tray 81; the reverse transport passage 75 in which the reverse roller 57 is provided for making the paper P having an image formed on one side thereof switch back; the return transport passage 76 for transporting the paper P turned upside down through the reverse transport passage 75 to the image forming portion 10; the branch transport passage 74 that branches off the ejection transport passage 73, and in which the transport rollers 55 and 56 are provided for transporting the paper P to the reverse transport passage 75; and the double-side transport unit 80 capable of clearing a paper jam. The double-side transport unit 80 includes the reverse transport passage 75, the return transport passage 76, and the reverse introduction passage 74*a* that extends from a downstream side, with respect to the branch transport passage 74, of the second transport roller 56, which is located close to the reverse transport passage 75, to the reverse transport passage 75. The double-side transport unit 80 is capable of being put in and taken out of the apparatus main body 1*a* in directions perpendicular to the paper transport direction.

According to this structure, when the paper P transported from the branch transport passage 74 is jammed in the vicinity of the reverse roller 57 in the double-side transport unit 80, even if the jammed paper P is stuck between the reverse transport passage 75 and the reverse introduction passage 74*a*, merely by pulling the double-side transport unit 80 in a direction perpendicular to the paper transport direction out of the apparatus main body 1*a*, the jammed paper P is taken out of the apparatus main body 1*a* together with the double-side transport unit 80, with no part of the jammed paper P remaining in the apparatus main body 1*a*. In this way, the paper jam is easily cleared.

According to the above embodiment, in the image forming apparatus 1, the double-side transport unit 80 includes: the reverse introduction passage 74*a*; and the junction portion 87*a* at which the transport passage for transporting the paper P that is made to switch back by the reverse roller 57 and the reverse introduction passage 74*a* meet each other, and the open/close subunit 85 is rotatable around the reverse drive roller 57*a*. With this structure, the open/close subunit 85 is made to rotate in its opening direction, so as to widely open the transport passage, and the jammed paper PJ taken out of the apparatus main body 1*a* together with the double-side transport unit 80 is easily taken out of the transport passage. Furthermore, the double-side transport unit 80 is provided with the junction portion 87*a* at which the transport passage for transporting the paper P that has been made to switch back by the reverse roller 57 and the reverse introduction passage 74*a* meet each other, and the reverse roller 57. With this structure, even if the double-side transport unit is repeatedly taken out of and put in the apparatus main body 1*a* to clear paper jams, the distance from the junction portion 87*a* to the reverse roller 57 does not vary but stays constant. As a result, sheets of paper P are transported at regular intervals even when double-side printing is continuously performed, and this facilitates control of paper transport.

According to the above embodiment, the reverse roller 57 is made to rotate so as to transport the paper P from the reverse introduction passage 74*a* to the reverse transport passage 75, the open/close subunit 85 has the detection member 91 for detecting passing of the paper P transported to the reverse introduction passage 74*a*, and the reverse roller 57 is made to reversely rotate based on detection of passing of the paper P by the detection member. With this structure, when passing of the paper P is detected by the detection member 91, the reverse roller 57 is made to reversely rotate. The detection member 91, the reverse roller 57, and the junction portion 87*a* are all provided in the open/close subunit 85, the paper transport distance between the detection member 91 and the reverse roller 57, and the paper transport distance between the reverser roller 57 and the junction portion 87*a* do not vary, and thus serially transported sheets of paper P are made to switch back at regular timings, and thus they are transported at regular intervals.

According to the above embodiment, the side panel 95 is provided to hold the second transport roller 56 at an end of the transport roller 56 in the axial direction thereof, and the side panel 95 has the cut portion 95*a* having a width sufficient to allow the paper P remaining in the branch transport passage 74 to pass therethrough. With this structure, if jammed paper PJ is stuck in the vicinity of the second transport roller 56 in the branch transport passage 74*a*, when the double-side transport unit 80 is pulled in the direction perpendicular to the paper transport direction and taken out of the apparatus main body 1*a* to clear the paper jam, an end of the jammed paper PJ passes through the cut portion 95*a*, and thus the jammed paper PJ is securely taken out of the apparatus main body 1*a*.

The present invention is applicable to an image forming apparatus employing an electro-photographic method such as a copier, a printer, a facsimile machine, and a multifunction peripheral having these functions, and in particular, the present invention is applicable to an image forming apparatus that has a function of forming images on both sides of paper and is also capable of treating paper jamming.

What is claimed is:

1. An image forming apparatus, comprising:

an image forming portion provided in an image forming apparatus main body;

an image forming transport passage for transporting paper having an image transferred thereon at the image forming portion to a fixing portion;

an ejection transport passage for transporting paper having an image fixed thereon to an ejection portion;

a reverse transport passage having a reverse roller for switching back paper having an image formed on one side thereof;

a return transport passage for transporting paper turned upside down through the reverse transport passage to the image forming portion;

a branch transport passage branching off the ejection transport passage and having at least one transport roller for transporting paper to the reverse transport passage;

a double-side transport unit including: the reverse transport passage; the return transport passage; and a reverse introduction passage extending, from a downstream side, with respect to the reverse roller, of the branch transport passage, to the reverse transport passage, the double-side transport unit being capable of being taken out of or put in the apparatus main body only in an axial direction of the transport roller; and a side panel for holding the transport roller at an end of the transport roller in the axial direction of the transport roller, wherein the side panel is fitted to the apparatus main body and has a cut portion which is formed substantially in a same shape as the transport passage of the branch transport passage to be wide enough for paper to pass therethrough in the axial direction of the transport roller, and the cut portion allows a rear end portion of paper remaining at the downstream side of the transport roller to pass therethrough when the double-side transport unit is pulled in the axial direction of the transport roller out of the apparatus main body to clear paper jam in the double-side transport unit.

2. The image forming apparatus according to claim 1, wherein the double-side transport unit comprises an open/close subunit that includes:

the reverse introduction passage; and a junction portion at which a transport passage for transporting paper switched back by the reverse roller and the reverse introduction passage meet each other, and wherein the open/close subunit is rotatable around the reverse roller.

3. The image forming apparatus according to claim 2, wherein the reverse roller is made to rotate so as to transport paper from the reverse introduction passage to the reverse transport passage, the open/close subunit has a detection member for detecting passing of paper transported to the reverse introduction passage, and the reverse roller is made to reversely rotate based on detection of passing of paper by the detection member.

4. The image forming apparatus according to claim 2, wherein the reverse roller includes a reverse drive roller and a reverse driven roller facing the reverse drive roller below the reverse drive roller, and wherein the open/close subunit is rotatable around the reverse drive roller.

5. The image forming apparatus according to claim 1, wherein the double-side transport unit includes:

a junction portion at which a transport passage for transporting paper switched back by the reverse roller and the reverse introduction passage meet each other; and a detection member for detecting passing of paper transported to the reverse introduction passage, and wherein the reverse roller is made to reversely rotate based on detection of passing of paper by the detection member.

6. The image forming apparatus according to claim 1, wherein the reverse transport passage is provided with a direction change roller for changing a paper transport direction by 180 degrees at a downstream side of the reverse roller in the paper transport direction.

7. An image forming apparatus, comprising:

an image forming portion;

a double-side transport unit including:

a reverse transport passage provided with a reverse roller for switching back paper having an image formed on one side thereof;

a return transport passage for transporting paper turned upside down through the reverse transport passage to the image forming portion; and a reverse introduction passage, extending from a downstream side of a branch transport passage having at least one transport roller, for transporting paper toward the reverse transport passage to the reverse transport passage, the double-side transport unit being capable of being taken out of or put in the apparatus main body only in an axial direction of the transport roller; and a side panel for holding the transport roller at an end of the transport roller in the axial direction of the transport roller, wherein the side panel is fitted to the apparatus main body and has a cut portion which is formed substantially in a same shape as the transport passage of the branch transport passage to be wide enough for paper remaining in the branch transport passage to pass therethrough in the axial direction of the transport roller, and the cut portion allows a rear end portion of paper remaining at the downstream side of the transport roller to pass therethrough when the double-side transport unit is pulled in the axial direction of the transport roller out of the apparatus main body to clear paper jam in the double-side transport unit.

* * * * *